US009027917B2

(12) United States Patent
Annerstedt et al.

(10) Patent No.: US 9,027,917 B2
(45) Date of Patent: May 12, 2015

(54) MACHINE AND METHOD FOR PRINTING PRODUCTS AND MAKING CUT-OUTS AT THE EDGES OF THE SHEETS

(75) Inventors: Tomas Annerstedt, Tungelsta (SE); Per Jacobsson, Vaesterhaninge (SE)

(73) Assignee: Tolerans AB, Tyreso (SE)

( * ) Notice: Subject to any disclaimer, the term of this patent is extended or adjusted under 35 U.S.C. 154(b) by 54 days.

(21) Appl. No.: 13/805,760

(22) PCT Filed: Jun. 10, 2011

(86) PCT No.: PCT/EP2011/059742
§ 371 (c)(1),
(2), (4) Date: Dec. 20, 2012

(87) PCT Pub. No.: WO2011/160969
PCT Pub. Date: Dec. 29, 2011

(65) Prior Publication Data

US 2013/0094891 A1 Apr. 18, 2013

(30) Foreign Application Priority Data

Jun. 21, 2010 (EP) ..... 10166655

(51) Int. Cl.
*B26D 9/00* (2006.01)
*B26D 1/40* (2006.01)
(Continued)

(52) U.S. Cl.
CPC *B26D 1/405* (2013.01); *B26D 9/00* (2013.01); *B26F 1/08* (2013.01); *B26F 1/12* (2013.01); *B26F 1/384* (2013.01); *B41F 13/56* (2013.01);
(Continued)

(58) Field of Classification Search
CPC ..... B26D 1/12; B26D 9/00; B26F 1/08; B26F 1/12; B26F 1/38; B26F 1/384; B41F 13/56; B41F 13/66; B41F 19/008; B42F 21/12; B42B 4/02
USPC ..... 270/4, 5.02, 5.03, 21.1, 52.07, 52.09, 270/58.07; 400/621; 428/131
See application file for complete search history.

(56) References Cited

U.S. PATENT DOCUMENTS 3,762,622 A 10/1973 Noren
3,958,051 A * 5/1976 Smith ..... 428/42.3
(Continued)

FOREIGN PATENT DOCUMENTS

DE 2922088 B1 10/1980
DE 19750855 A1 5/1999
(Continued)

OTHER PUBLICATIONS

European Office Action mailed Jan. 24, 2012.
(Continued)

*Primary Examiner* — Leslie A Nicholson, III
(74) *Attorney, Agent, or Firm* — Harness, Dickey & Pierce, P.L.C.

(57) ABSTRACT

A puncher cylinder includes a puncher knife, the cylinder being arranged for cooperation with a paper web such that the cylinder when in use can be rolled longitudinally along and in contact with the paper web, punching holes in the paper web by way of the puncher knife. The holes are punched a longitudinal distance from each other essentially corresponding to the circumference of the cylinder. A system is further disclosed including the punching cylinder, as is a method utilizing the punching cylinder, and a newspaper partly produced by way of the punching cylinder.

17 Claims, 4 Drawing Sheets

(51) Int. Cl.

| | |
|---|---|
| ***B26F 1/08*** | (2006.01) |
| ***B26F 1/12*** | (2006.01) |
| ***B26F 1/38*** | (2006.01) |
| ***B41F 13/56*** | (2006.01) |
| ***B41F 13/66*** | (2006.01) |
| ***B41F 19/00*** | (2006.01) |
| ***B42B 4/02*** | (2006.01) |
| ***B42D 7/00*** | (2006.01) |
| ***B42F 21/12*** | (2006.01) |
| ***B41J 11/70*** | (2006.01) |
| *B42D 1/00* | (2006.01) |

(52) U.S. Cl.

CPC ..... *B41F 13/66* (2013.01); *B41F 19/008* (2013.01); *B42B 4/02* (2013.01); *B42D 1/001* (2013.01); *B42D 7/00* (2013.01); *B42F 21/12* (2013.01); *B41J 11/70* (2013.01)

(56) References Cited

U.S. PATENT DOCUMENTS

| | | | | |
|---|---|---|---|---|
| 3,964,356 | A * | 6/1976 | Dineen | 83/302 |
| 5,474,221 | A | 12/1995 | Klinga | |
| 5,690,266 | A | 11/1997 | Klinga | |
| 6,279,443 | B1 | 8/2001 | Nakahara et al. | |
| 7,059,226 | B2 * | 6/2006 | Alon et al. | 83/76 |
| 2007/0113751 | A1 | 5/2007 | Alon et al. | |
| 2010/0006617 | A1 | 1/2010 | Jacobsson | |

FOREIGN PATENT DOCUMENTS

| | | | |
|---|---|---|---|
| DE | 10306004 | B3 | 9/2004 |
| EP | 0963821 | A1 | 12/1999 |
| EP | 2039640 | A2 | 3/2009 |
| GB | 1303838 | A | 1/1973 |
| GB | 2305894 | A | 4/1997 |
| JP | 3037075 | U | 5/1997 |
| WO | WO-9941049 | A1 | 8/1999 |
| WO | WO-0220229 | A1 | 3/2002 |
| WO | WO-2009072975 | A1 | 6/2009 |
| WO | WO-2009072976 | A1 | 6/2009 |

OTHER PUBLICATIONS

European Office Action mailed Nov. 29, 2012.
International Search Report PCT/ISA/210 for International Application No. PCT/EP2011/059742 dated Jul. 15, 2011.
European Search Report for Application No. 10166655.0 dated Nov. 23, 2010.
Written Opinion of the International Searching Authority PCT/ISA/237.

* cited by examiner

MACHINE AND METHOD FOR PRINTING PRODUCTS AND MAKING CUT-OUTS AT THE EDGES OF THE SHEETS

FIELD OF THE INVENTION

The present invention relates to hole punching in a paper web.

BACKGROUND OF THE INVENTION

Newspapers or similar papers often comprise a plurality of sections, e.g. one main section and one or several supplementary sections such as a sports section and/or an economy section, where the different sections are inlaid in each other. Each section may e.g. be stapled, glued or just folded together. A first supplementary section may be positioned between the centre fold of the main section and a second supplementary section may be positioned between the centre fold of the first supplementary section etc, or the separate sections may be otherwise inlaid in each other. To separate the different sections from each other, a reader may search through the combined paper to find the different sections or shake the paper to allow the sections to fall out; the latter strategy only being convenient if the sections are internally fastened, e.g. stapled or glued, such that individual sheets of paper of the sections are not shaken free.

Rotary stapling machines for stapling a multi layer paper web are known in the art, see e.g. the publications WO 09/072,975, WO 09/072,976, US 2010/006617, WO 02/20229, WO 99/41049, U.S. Pat. Nos. 5,474,221, 5,690,266, 3,762,622.

SUMMARY OF THE INVENTION

It is an objective of the present invention to alleviate problems of the prior art. Further advantages will be apparent from the following discussion.

In accordance with an aspect of the present invention, there is provided a puncher cylinder comprising a puncher knife, the cylinder being arranged for cooperation with a paper web such that the cylinder when in use can be rolled longitudinally along and in contact with the paper web, punching holes in the paper web by means of the puncher knife, which holes are punched a longitudinal distance from each other essentially corresponding to the circumference of the cylinder.

The puncher cylinder may be any type of cylinder able to be rolled longitudinally along and at least partially and/or intermittently in contact with the paper web. The cylinder may be principally round, e.g. principally circular, in order to facilitate the rolling along the paper web. However, the puncher cylinder might not, e.g. depending on how the puncher knife is arranged in the puncher cylinder, be completely round even if it is principally round. Typically, when in use, the paper web will be moving longitudinally and the puncher cylinder will be rolling longitudinally along the web by spinning or revolving in a stationary manner, i.e. the rotational axel or axis is stationary while the cylinder revolves around it, but other embodiments, where the rotational axis is not stationary, are also contemplated.

The cylinder may have any extension along its rotational axis which allows the cylinder to comprise and hold the puncher knife in a suitable manner. The puncher cylinder may have an axial extension that principally corresponds to the width of the paper web, allowing the puncher cylinder to interact with the web over the web's entire width, or the puncher cylinder may have a much smaller axial extension which is only enough to comprise the puncher knife, saving space and material. A smaller axial extension of the puncher cylinder may allow for using a plurality of puncher cylinders in parallel for interaction with transversely different parts of the paper web, or a combination of at least one puncher cylinder and at least one other cylinder or device for interacting with the paper web, such as a stitching or stapling cylinder/device, may similarly be used in parallel. Such parallel cylinders or devices may be arranged to revolve around a common axis and/or arranged on a common axel. Typically, a puncher cylinder may have an axial extension at its web facing surface of between 1 and 20 centimeters, such as between 2 and 5 centimeters.

The cylinder is, when in use, at least intermittently in direct contact with the paper web, allowing the cylinder to act to punch holes in the paper web. Also, the cylinder may be in contact with the web such that the paper web and the outer surface of the cylinder move together aided by friction between the web surface and the cylinder surface, e.g. the longitudinal velocity of the paper web may be principally the same as the velocity of the cylinder surface as brought about by the rotation of the cylinder. As a result of friction between the web and the cylinder, the longitudinal motion of the web may be at least partially driven by the cylinder and/or the rotation of the cylinder may at least partly be driven by the longitudinal motion of the web.

Alternatively, the puncher cylinder may principally only be in direct contact with the web when the puncher knife is punching a hole in the web. Although the puncher cylinder might not be in contact with the web during its whole revolution around its axis, but e.g. principally only during the actual hole punching, it may still be convenient to match the surface velocity of the puncher cylinder with the velocity of the web in order to avoid slippage or abrasion, or, especially, tearing of the web during hole punching therein. If the cylinder and its puncher knife has the same velocity as the web when it contacts the web, hole punching without tearing or deforming of the web may be facilitated.

The puncher cylinder comprises a puncher knife by means of which the puncher cylinder may punch holes in the paper web when in use. The puncher knife is thus arranged in the cylinder such that the knife can get direct access to the web and punch holes in it while the cylinder is longitudinally rolled along the web. Typically, the knife is arranged at a surface of the cylinder which is arranged to be in contact with the paper web. The knife may e.g. be a hollow cylinder with sharp edge at one of its two ends and a cross-section, perpendicular to the axis of symmetry of the hollow cylinder, which principally corresponds to the shape of the holes to be produced in the web. Also other geometries of the knife are possible, and may in some cases be preferred, such as a hollow truncated cone or inverted cone, or a movable blade. Also, the knife may comprise a plurality of cutting parts, instead of a single cylinder or frustum. Using a single cylinder may be convenient since it is a simpler and less complex arrangement with lower production and maintenance costs.

The holes punched by the knife of the cylinder when in use are punched a longitudinal distance from each other, as measured from the geometrical or symmetrical centres of the holes, essentially corresponding to the circumference of the cylinder. This implies that a hole is punched with every revolution of the cylinder if the cylinder revolves with a speed corresponding to the longitudinal displacement of the cylinder along the paper web. In this context, the distance may be relating to the distance between longitudinally successive holes, but it is also contemplated to use a cylinder comprising one or a plurality of knifes arranged to produce a plurality of holes, longitudinally and/or transversely displaced in respect of each other, in the web with each revolution of the cylinder. For instance, a puncher cylinder arranged to punch one hole per revolution may be directly replaced by a puncher cylinder having twice the circumference and comprising two puncher knifes, diametrically positioned at the circumferential surface of the puncher cylinder. Using a puncher cylinder as here described may be a convenient way of producing a hole in a web, especially a web that is moving since there may be no need to allocate extra time to the hole punching as it may be performed continuously while the web is anyway moving between different steps e.g. in a printing or folding machine. The puncher cylinder may thus be integrated in e.g. a printing or folding machine or the like. It may also be a convenient way of ensuring the repeatability of the hole positioning since the positioning of and distance between holes may be set by choosing the diameter of the cylinder and the position of the knife in the cylinder and/or the transverse positioning of the cylinder in respect of the web.

The knife may be principally stationary in relation to the cylinder body and may thus punch a hole in the web by e.g. extending somewhat from the cylinder surface such that when the part of the cylinder surface where the knife is arranged rolls in contact with the web, the knife is pressed into the web, punching a hole in the web. An advantage with a stationary knife is that less moving parts implies a lower maintenance cost. Alternatively, the knife may be movable, e.g. spring loaded, and pressed into the web in that way. Other knife designs are also possible as long as a hole may be produced in the web.

The paper web may be any type of paper web, such as a paper web for newspapers or book printing. The paper may e.g. be cellulose based paper, such as newspaper paper or writing paper, or cotton based paper, or any other type of paper. Conveniently, a paper web for newspapers or books or the like is used with the present invention.

The paper web may comprise one or a plurality of layers. For instance, a paper web may correspond to a section of a newspaper that comprises a plurality of sheets, whereby the paper web comprises as many layers as there are sheets in the newspaper section, one sheet typically providing four pages of the newspaper section. The plurality of layers may be formed by folding a wider web and still be attached to each other, or the layers may be separate from each other and only superimposed on top of each other. When punching a hole in the paper web, the hole may be punched through all of the layers of the web.

There may be many reasons for punching holes in a paper web, e.g. a newspaper web. The holes may be positioned differently in the sheets and pages of the final newspaper, or newspaper section, depending on where the web is cut, to form sheets, in relation to the holes of the web.

According to another aspect of the present invention, there is provided a system for punching holes in a paper web, the system comprising: a puncher cylinder as discussed above; and an opposing cylinder; wherein the puncher cylinder and the opposing cylinder are arranged to, when in use, roll against each other on opposite sides of the paper web, pressing the paper web between the cylinders.

By using an opposing cylinder that is arranged to roll against the paper web on the opposite side of the web in relation to the puncher cylinder, a higher friction between the puncher cylinder and the web may be obtained, facilitating the punching of the puncher cylinder, and also reducing the risk of slippage and abrasion between the paper web and either of the two cylinders, especially during punching. The discussion above relating to the design and movement of the puncher cylinder, and its cooperation with the paper web, is also relevant for the opposing cylinder, if applicable, but the opposing cylinder does not necessarily comprise a puncher knife. The paper web may be pressed between the two cylinders during the entire revolutions of the cylinders, or, which may be more convenient, only during the hole punching.

The discussion above, relating to the puncher cylinder, is also relevant to the system. Reference is made to that discussion.

According to another aspect of the present invention, there is provided a method of punching holes in a paper web, the method comprising: allowing a longitudinally moving paper web to pass between and being pressed between two opposing, stationary and revolving cylinders, one of the two cylinders being a puncher cylinder comprising a puncher knife and the other of the two cylinders being an opposing cylinder; and punching a hole in the paper web by means of the puncher knife where the moving paper web is pressed between the two cylinders with each revolution of the puncher cylinder. It is not essential that the two cylinders are completely stationary, they may for instance be mounted with a suspension allowing them to move slightly.

Conveniently, the puncher cylinder or the system discussed above is used for performing the inventive method. Reference is made to the discussions above relating to the puncher cylinder and the system.

According to another aspect of the present invention, there is provided a newspaper comprising at least a first and a second separate sections wherein the second section is inlaid in the first section and the first section has two cuts (or indentations) through all of its sheets, the cuts forming a first recess in one edge of the sheets and a corresponding second recess in the opposing edge of the sheets, such that when the sheets are folded to form the newspaper section, they together form a single recess in an edge of the newspaper section.

The inventive newspaper may conveniently be produced at least partly by means of the inventive method, the inventive puncher cylinder and/or the inventive system. A paper web, typically comprising a plurality of superimposed paper layers, may have holes in it, such as holes produced by means of the inventive method, the inventive puncher cylinder and/or the inventive system as discussed above. By cutting the paper web, typically with an in-line cutting knife, into rectangular sheets such that the cut is made through at least one of the holes, a recess in an edge of the sheets may be obtained. If the paper web comprises a plurality of layers, a corresponding plurality of superimposed sheets, all having the same edge recess, may be produced with every cut of the cutting knife. Typically, the sheets may be obtained by transversely cutting over the entire width of the paper web. To produce a newspaper section, or the like, from the sheet or superimposed sheets, the sheets may be folded once along an axis of symmetry of the sheets, which axis may be parallel to two edges of the sheets and perpendicular to and intercepting the other two edges of the sheets. Optionally, the sheets of the section may be fastened together by e.g. stitching, stapling or gluing at the fold along the axis of symmetry.

The inventive newspaper has a section comprising two recesses in edges of all of its sheets such that when the sheets have been folded to a newspaper, the two recesses combine to form a single recess through all the leaves of the newspaper in an edge of the newspaper, i.e. the two recesses are superimposed on each other when the sheets are folded to a newspaper. This may e.g. be achieved with the two recesses being in the same edge of the superimposed sheets, the edge being one of those that are perpendicular to the axis of symmetry where the sheets are folded and the recesses being symmetrically positioned one on either side of the axis of symmetry, i.e. on either side of the longitudinal middle of the edge. In accordance with this alternative, the combined recess of the newspaper section will be positioned in one of the edges of the newspaper section that are perpendicular to the edge where the fold is. Another alternative is with the two recesses in different and opposing sheet edges parallel with the axis of symmetry fold, specifically the first recess may be positioned in one of the two sheet edges that are parallel to the symmetry axis and the second recess may be positioned in the other one of the two sheet edges that are parallel to the symmetry axis, the first and second recesses being positioned in the respective edges at the same distances from the sheet edges that are perpendicular to the symmetry axis. In accordance with this latter alternative, the combined recess of the newspaper section will be positioned in the edge of the newspaper section that is opposing to the edge where the fold is.

An advantage with a newspaper comprising a section with a recess as discussed above may be that if another section is inlaid in the recessed section, especially if the inlaid section is of approximately the same shape and size as the recessed section thus allowing the inlaid section to protrude from the recessed section in the recess, the inlaid section may be easily seen, by e.g. a newspaper reader, thus alerting the reader to the presence of the inlaid section, and may also be more easily separated from the recessed section since the recess may allow the reader to grip, e.g. with his/hers fingers, the inlaid section where it, in the recess, protrudes from the recessed section and extract the inlaid section from the recessed section.

BRIEF DESCRIPTION OF THE DRAWINGS

In the following, specific embodiments of the different aspects of the present invention will be discussed with reference to the drawings, wherein.

DETAILED DESCRIPTION

Definitions

Figure 1:
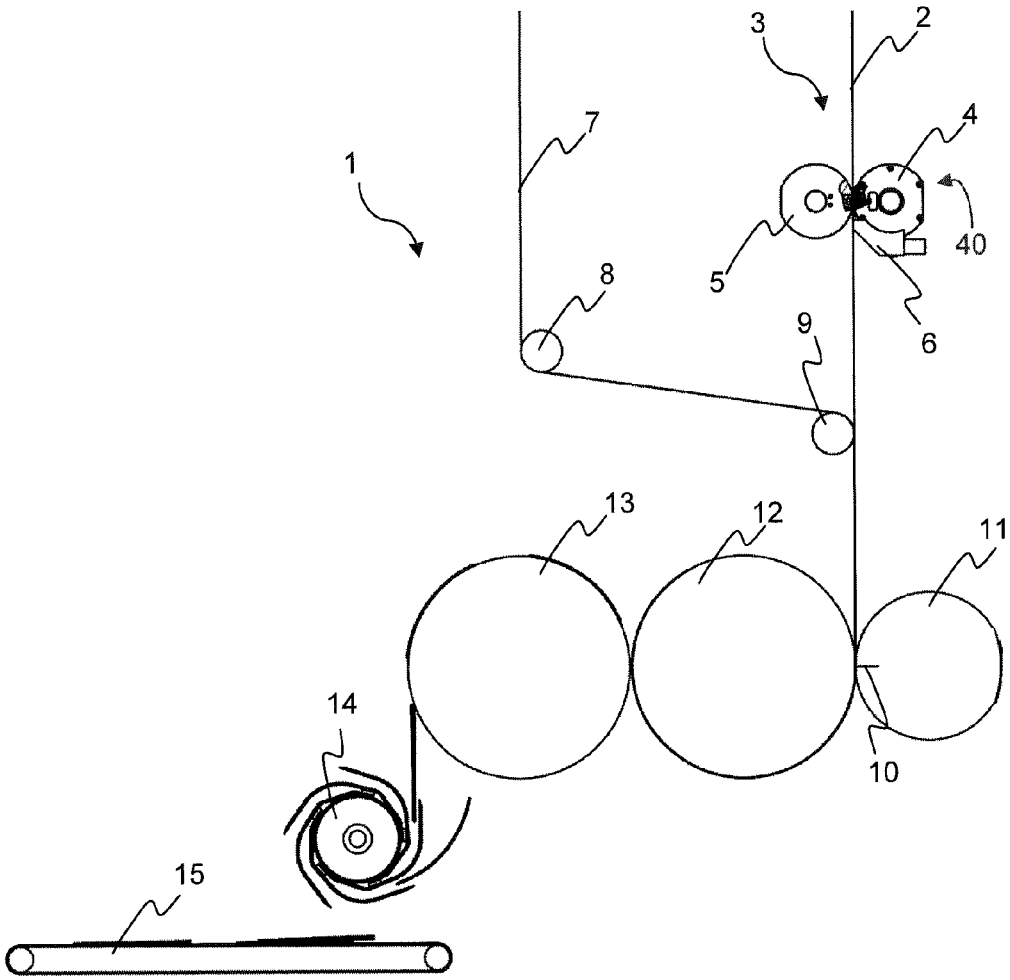
FIG. 1 is a schematic side view of a part of a newspaper printing machine where an embodiment of the present invention is employed.

Here follow a few definitions of terms used above and below.

A paper web is a long, continuous paper "ribbon" which may have any width and is usually processed by moving over rollers or cylinders or such. A paper web may comprise a plurality of superimposed layers of paper.

A sheet of paper is discrete and cut from a paper web, typically having the same width as the web it is cut from, i.e. the web is only cut transversely to form a sheet, and being essentially rectangular. If the web comprises a plurality of layers, a corresponding number of (superimposed) sheets is formed by cutting the web, i.e. each layer forms a sheet. The superimposed sheets may be folded once to form a newspaper.

In a newspaper, or the like, each folded sheet may form two leaves and four pages, back and front sides of each leaf, of the newspaper.

A newspaper, or the like, may comprise a plurality of sections, such as a main section a sports section etc. A section may comprise a plurality of sheets which may be fastened to each other, e.g. by means of stitching, staples or glue, or just folded together. The different sections of a newspaper may be inlaid in each other as mentioned above and/or folded together.

A newspaper, as mentioned in this specification, is a generic term covering also "newspapers" that do not necessarily contain news or even text or printed matter at all. Rather, a newspaper is an item comprising a plurality of paper sheets that are folded once to form the newspaper. Hence, the newspaper may be any printed article (or printed product). For example, the newspaper may be in a broad-sheet format, or preferably in a tabloid format. When the shape, edges etc. of a newspaper or newspaper section is discussed, it is in relation to the flat-laying newspaper formed by folding its sheets once along the axis of symmetry, thus being rectangular and comprising four edges, one of which is formed by the fold.

Detailed Description of Specific Embodiments of The Invention

It may be convenient to use a puncher knife which is arranged for punching holes in the web which are sufficiently large, e.g. holes with a maximum diameter of at least 1 centimeter, such as at least 1.5, 2 or 3 centimeters. This may be advantageous if e.g. the holes are to give recesses that allows a person to access into the recesses with his/hers fingers. Conveniently, the puncher knife may be arranged for punching holes in the web which have a maximum diameter which is less than 10 centimeters, such as less than 7, 5, 4 or 3 centimeters. An advantage of keeping down the hole size may be that a too large hole may reduce the printable area of the sheets made from the web and/or may reduce the structural integrity of the web or sheets.

The holes may have any shape, and which shapes that are convenient may vary depending on the objective of producing the holes. It may be convenient to allow the holes to be mirror symmetrical. This may be an advantage if e.g. a cutting knife is to cut the web into sheets by cutting through the middle of the holes, along an axis of symmetry of the holes, thus enabling producing two symmetrical recesses in the edges of the two sheets, or stacks of superimposed sheets, that are separated by the cutting knife. Thus, it may be convenient to use a puncher knife is arranged for punching holes which are mirror symmetrical.

It may be convenient with holes of a shape essentially without corners or other notches, to increase the structural integrity of the holes and any recesses, or rather the periphery thereof, especially to avoid ripping the web or sheet paper at the hole or recess. It may thus be convenient to use a puncher knife which is arranged for punching holes which have an essentially round shape, such as a circular or elliptical shape.

The puncher cylinder might further be arranged for cooperation with an opposing cylinder arranged to be rolled longitudinally along and in contact with the paper web on the opposite side of the paper web in respect of the puncher cylinder, such that the paper web is at least intermittently pressed between the puncher cylinder and the opposing cylinder, the puncher cylinder being arranged to be linked with the opposing cylinder such that it has an angular velocity which is fixed in relation to the angular velocity of the opposing cylinder when the puncher cylinder is in use. The use of an opposing cylinder has previously been discussed in relation to the inventive system. By linking the puncher cylinder to an opposing cylinder such that the angular velocity of the puncher cylinder is set in relation to the angular velocity of the opposing cylinder, the surface velocity of the cylinder surface may be adjusted to match the surface velocity of the opposing cylinder surface, and both of the surface velocities may be adjusted to match the longitudinal velocity of the paper web to minimise slippage or abrasion. If the circumference of the puncher cylinder is essentially the same as the circumference of the opposing cylinder, the angular velocity of the puncher cylinder may be set to be the same as the angular velocity of the opposing cylinder in order to obtain essentially matching surface velocities. Further, by linking the angular velocities such that they are essentially the same, it may be ensured that the same part of the puncher cylinder surface meet the corresponding same part of the opposing cylinder surface on respective sides of the paper web with each revolution, regardless of whether the respective circumferences of the puncher and opposing cylinders are the same. If e.g. the puncher knife is positioned at a specific part of the puncher cylinder surface and the opposing cylinder comprises a pad, such as a rubber pad or the like, at a specific part of its surface and the pad is arranged to act as support for the punching knife such that the punching knife meets the pad when punching through the web, linking the two cylinders to have identical angular velocities may ensure that the pad and knife meets at each revolution.

Thus, the opposing cylinder may comprise a pad arranged to meet the puncher knife of the puncher cylinder when the puncher knife punches a hole in the paper web. This pad may form part of the circumferential surface of the opposing cylinder and may be arranged to ensure that the puncher knife does not meet or cut against the main material of the opposing cylinder, typically metal. The pad may thus only be large enough to accommodate the cutting end of the puncher knife during punching, but it may be convenient to allow the pad to be even larger to allow a higher tolerance for where the puncher knife meets the circumferential surface of the opposing cylinder. Also, if the pad is larger, e.g. principally covering all the circumferential surface of the opposing cylinder or forming a continuous ring around the cylinder, it may be possible to change the place where the puncher knife meets the pad from a place where the pad has been worn to a fresh place of the pad.

As discussed above, it may be convenient to obtain e.g. newspaper sections that are stapled, stitched or glued together. One way of realising this is by stapling the paper web before it is cut into sheets. To achieve this, it may be convenient to arrange a stapler in a cylinder that may be rolled longitudinally along and in contact with the paper web, such that the stapler may position a staple or staples in the web once with each revolution of the cylinder. The staples are positioned at the symmetry axis of the sheets, when cut from the web, where the sheets may be folded into newspaper sections. It has now been realised that this stapling cylinder may conveniently be combined with the puncher cylinder, whereby the puncher cylinder may comprise both a puncher knife and a stapler. If the holes are to be punched where the cutting knife will cut the web into sheets to produce the recesses discussed above, the stapler is conveniently arranged in the puncher cylinder such that a staple or staples may be placed in the paper web longitudinally essentially halfway between each of the punched holes. Thus, the puncher cylinder may further comprise a stapler, the stapler being arranged in the puncher cylinder such that staples may be placed in the paper web longitudinally essentially halfway between the punched holes when the puncher cylinder is in use.

The puncher cylinder may be associated with a stationary vacuum cleaner which is stationary in respect of the rotational axis of the puncher cylinder and does not rotate together with the cylinder. The vacuum cleaner may be arranged to clean away the paper parts that are punched away from the paper web in order to avoid those free paper parts interfering in the processing of the paper web etc, or in order to more generally avoid making a mess in the room where the puncher cylinder is used.

The inventive newspaper discussed above comprises more than two sections, e.g. three or four or any other number of sections. The person skilled in the art will realise that the present invention may include such newspapers. In general, a first section may have at least one recess more than a second section referring to the state when the sheets of the sections are folded. If a third section is added, it may have at least one recess more than the second section, and so on. For example, a newspaper comprising three sections, where e.g. a third section is inlaid folded between the centrefold of a second section which is in its turn inlaid folded between the centrefold of a first section, may be produced such that the first section has two separate recesses in any of its edges, both in the same edge or in two different edges, of course not the edge with the fold, and the second section has one recess in one of its edges which recess is superimposed with one of the recesses of the first section. In this way the third section may be detectable and/or accessible in the recess which is present in both the first and second sections, and the second section may be detectable and/or accessible in the recess which is present in only the first section. In analogous way, newspapers with more than three sections inlaid in each other may be arranged. In this example, the first section has two recesses which may mean that the web from which it is cut is prepared with two transversely separate holes along the same transverse line, i.e. essentially not longitudinally separate. This may e.g. be achieved using two separate puncher cylinders, conveniently arranged in parallel on the same axel, with that web, but in some instances it may be convenient to use a puncher cylinder with a puncher knife that produces two separate holes with each revolution of the cylinder or a puncher cylinder with two puncher knifes producing one hole each with each revolution of the cylinder. In analogous way also more than two holes may be produced with each revolution of the cylinder.

With reference to the appended drawings specific embodiments of the present invention will now be discussed.

Turning to FIG. 1, a part of a newspaper printing machine 1 is schematically illustrated. The printing machine 1 is preferably adapted to produce newspapers (or printed articles in general) in a broad-sheet or a tabloid format. When a broad-sheet format newspaper is produced, the sheets are folded in a direction parallel with the direction of movement of the paper web. Therefore, it is advantageous to use glue to fasten the sheets together since a glue applying means can be stationary in the printing machine and apply a continuous string of glue as the paper web travels by. When a tabloid format is produced, the sheets are folded in a direction perpendicular to the direction of movement of the paper web. Therefore, it is advantageous to use stapling or stitching to fasten the sheets together, since the longitudinal direction of the staples then is parallel to the axis of the stapling cylinder.

In the printing machine, a first paper web 2 passes through a punching machine 3 comprising a puncher cylinder 4, an opposing cylinder 5 and a vacuum cleaner 6. The puncher cylinder 4 may include a stapler 40. A second paper web 7 passes two lead rollers 8 and 9 and is combined with the first paper web 2. The first paper web 2 relates to the main section of the newspaper that is produced and the second paper web 7 relates to a subsection that will be folded between the centre fold of the main section. The combined web 2 and 7 is cut into sheets by the cutting knife 10 between the cutting cylinder 11 and the first folding cylinder 12. Preferably, the cutting knife 11 is arranged to cut the paper web in a direction transverse to the direction of motion of the paper web, i.e. transversely over the width of the paper web. The cut sheets, which are stacks of sheets from both webs 2 and 7, are guided along the circumference surface of the first folding cylinder 12, below the cylinder 12 in FIG. 1, held by small spikes or pins (not shown). When the sheets meet the second folding cylinder 13, clips or tongs or the like (not shown) will grab the stack of sheets over the middle of the stack, thus folding the stack into a newspaper, and the newspaper is held by the clip and guided along the circumference surface of the second folding cylinder 13, above the cylinder 13 in FIG. 1, until it is released from the clip into the delivery wheel (fan wheel) 14 which places the newspaper on the conveyor belt 15.

Figure 2:
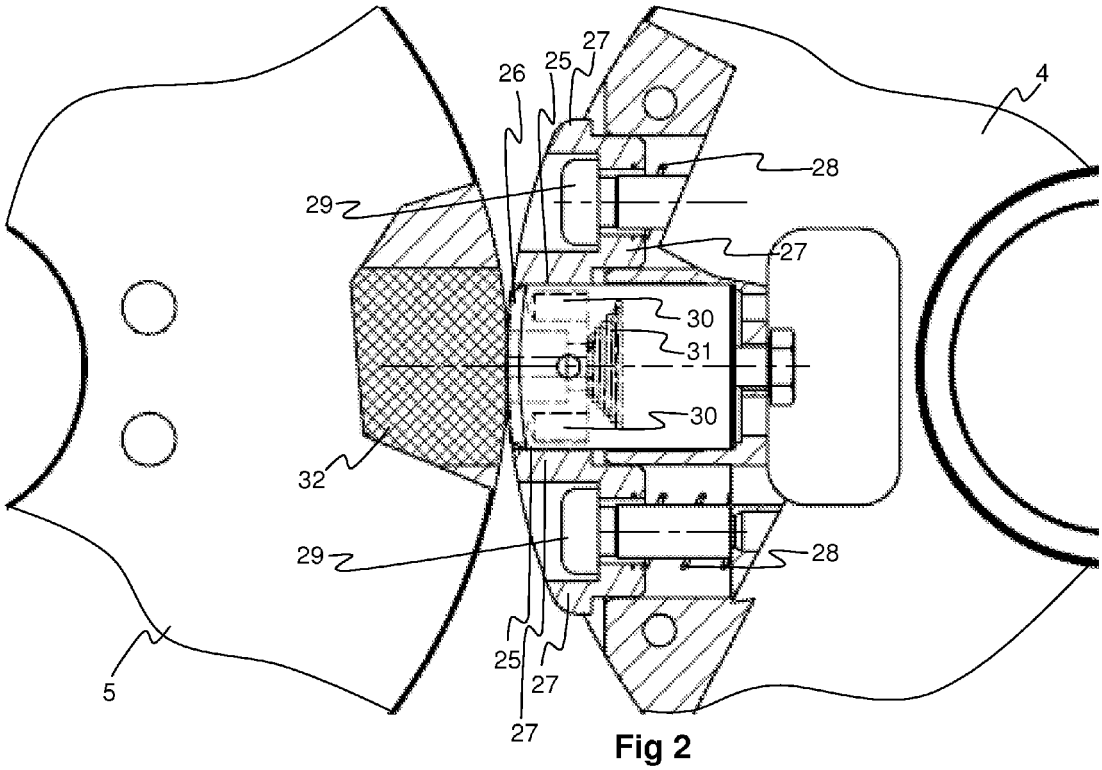
FIG. 2 is a schematic partial enlargement, partially in cross-section, of the punching machine of FIG. 1.

FIG. 2 is an enlargement of a part of the punching machine 3 of FIG. 1, partially in cross-section. The puncher cylinder 4, to the right in the figure, and the opposing cylinder 5, to the left in the figure, meet in the middle of the figure. When the machine 3 is in use, a paper web 2 (FIG. 1) will pass between the cylinders 4 and 5 in the middle of the figure.

The puncher cylinder 4 has a puncher knife 25 in the form of a cylinder having a sharp cutting edge 26. According to this exemplary embodiment, the puncher knife is immovably fixed in the puncher cylinder 4. The puncher knife 25 protrudes somewhat from the circumferential surface of the puncher cylinder.

Outside and encompassing the puncher knife 25 there is provided a spring loaded ring 27, with springs 28, arranged to protect the cutting edge 26, as well as protect the surroundings from the very sharp cutting edge 26, when the puncher knife is not meeting the opposing cylinder 5 and punching a hole in a paper web 2. When the puncher knife is pressed against the web 2 and the opposing cylinder 5, the spring loaded ring 27 is pressed and moved towards the central axis of the puncher cylinder 4, baring the edge 26 of the puncher knife 25, allowing the edge 26 to cut through the web 2. When the puncher knife is no longer pressed against the web 2 and the opposing cylinder 5, the ring 27 is again pushed out by the springs 28 until stopped by the screw heads 29 to protect the edge 26. The ring 27 may e.g. be made of bakelite.

Arranged inside the cylindrical puncher knife 25, there is provided a spring loaded paper ejector 30 arranged with a spring 31. Similarly to the ring 27, the paper ejector 30 covers and protects the cutting edge 26 but may be pressed and moved towards the central axis of the puncher cylinder 4 when pressed against the web 2 and opposing cylinder 5, baring the edge 26 of the puncher knife 25 and allowing it to cut through the web 2. However, the paper ejector 30 also has the function of ejecting any cut out paper bits from the inside of the puncher knife 25 after a hole has been punched and the spring 31 moves the ejector 30 back, avoiding clogging of paper within the puncher knife 25 which may detrimentally effect the ability of the puncher knife to operate and cleanly punch further holes. The ejected paper bits may be captured by the vacuum cleaner 6 (FIG. 1). The ejector 30 may e.g. be made of bakelite.

The opposing cylinder 5 is provided with a pad 32 arranged to meet the puncher knife as it is punching a hole in the web 2. The pad may e.g. be a rubber pad made of latex or synthetic rubber.

Figure 3A:
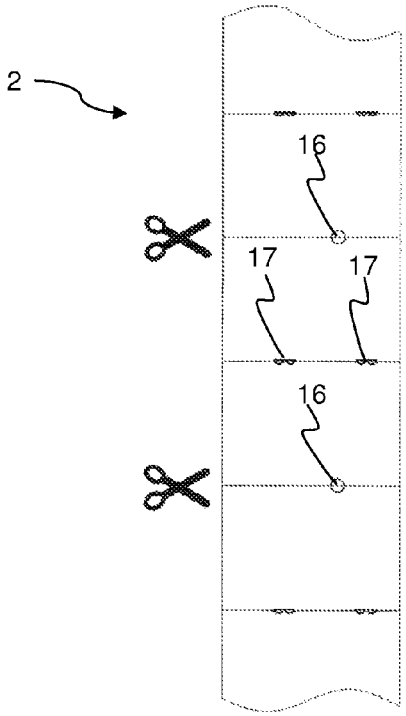
FIG. 3*a-b* are schematic front views of a paper web after interaction with an embodiment of a puncher cylinder of the present invention.

FIG. 3*a* schematically illustrates the first paper web 2 with holes 16 punched through it. The holes 16 are positioned such that the web 2 is arranged to be cut (as illustrated by the scissors in the FIG. 4*a*) by the cutting knife 10 (FIG. 1) through the middle of the holes 16. Halfway between the holes 16, staples 17 are placed where a fold will be made to produce a newspaper.

Figure 3B:
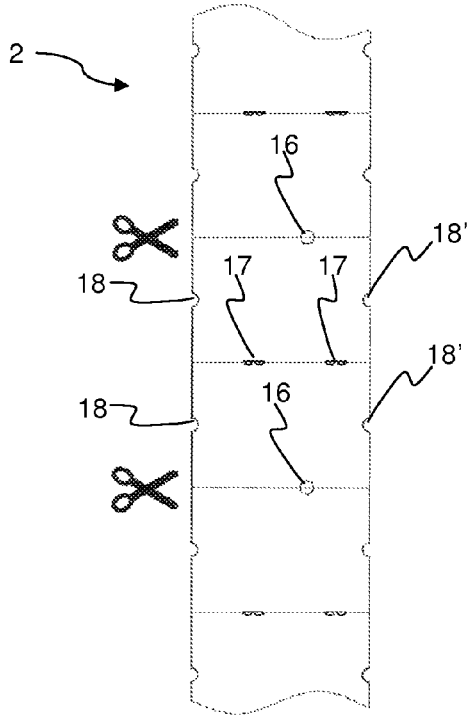

FIG. 3*b* schematically illustrates the first paper web 2 with holes 16, but also holes/half holes/cut-outs 18, punched through it. Again, the holes 16 are positioned such that the web 2 is arranged to be cut (as illustrated by the scissors in the FIG. 4*a*) by the cutting knife 10 (FIG. 1) through the middle of the holes 16. It is appreciated that it is not essential that the cut has to be made exactly through the middle of the holes, but it is preferred to arrange it at least almost through the middle of the holes. The holes 18 are positioned in the edges of the web 2. When a newspaper section is produced from the web 2, it will have three cut-outs at its edges, one formed by the two half holes 16 (as is also the case for the section formed from the web in FIG. 3*a*), one formed by the two half holes 18 and one formed by the two half holes 18'.

Figure 4A:
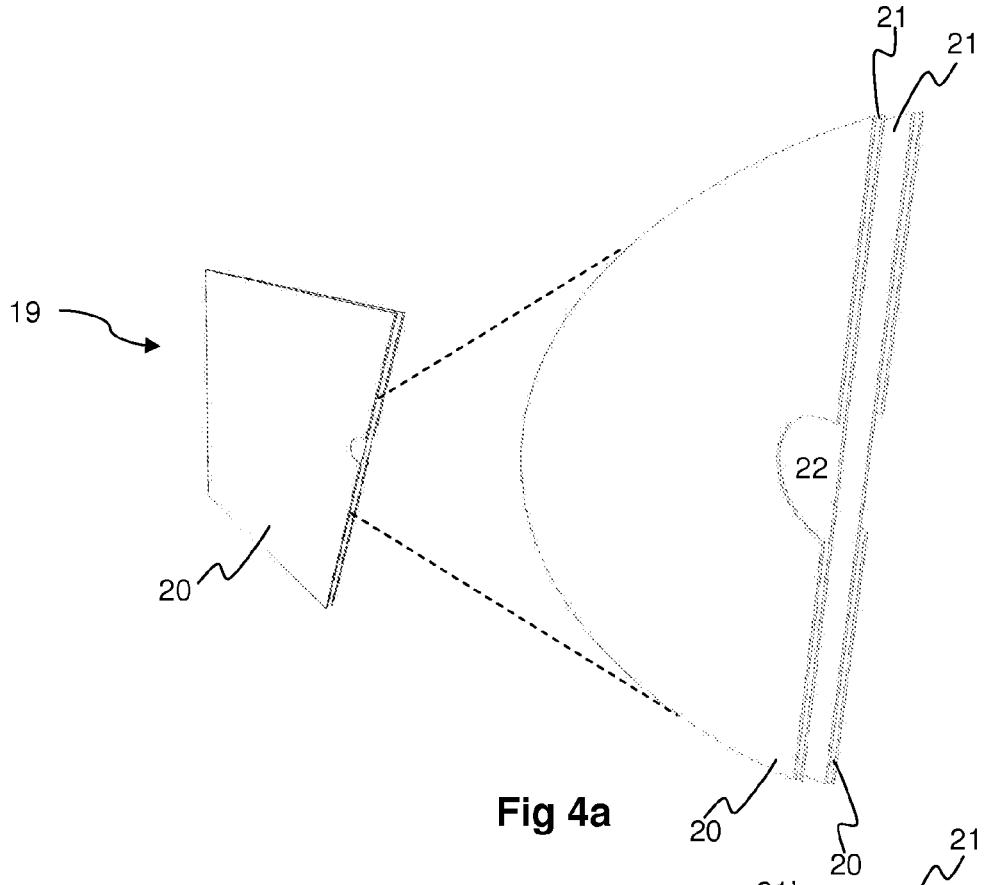
FIG. 4*a-b* are schematic perspective views, with partial enlargements, of newspapers prepared using embodiments of the present invention.

FIG. 4*a* schematically illustrates a newspaper 19 comprising two sections, a main section 20 and a subsection 21 that is visible and accessible through the cut-out 22 of the main section 20.

Figure 4B:
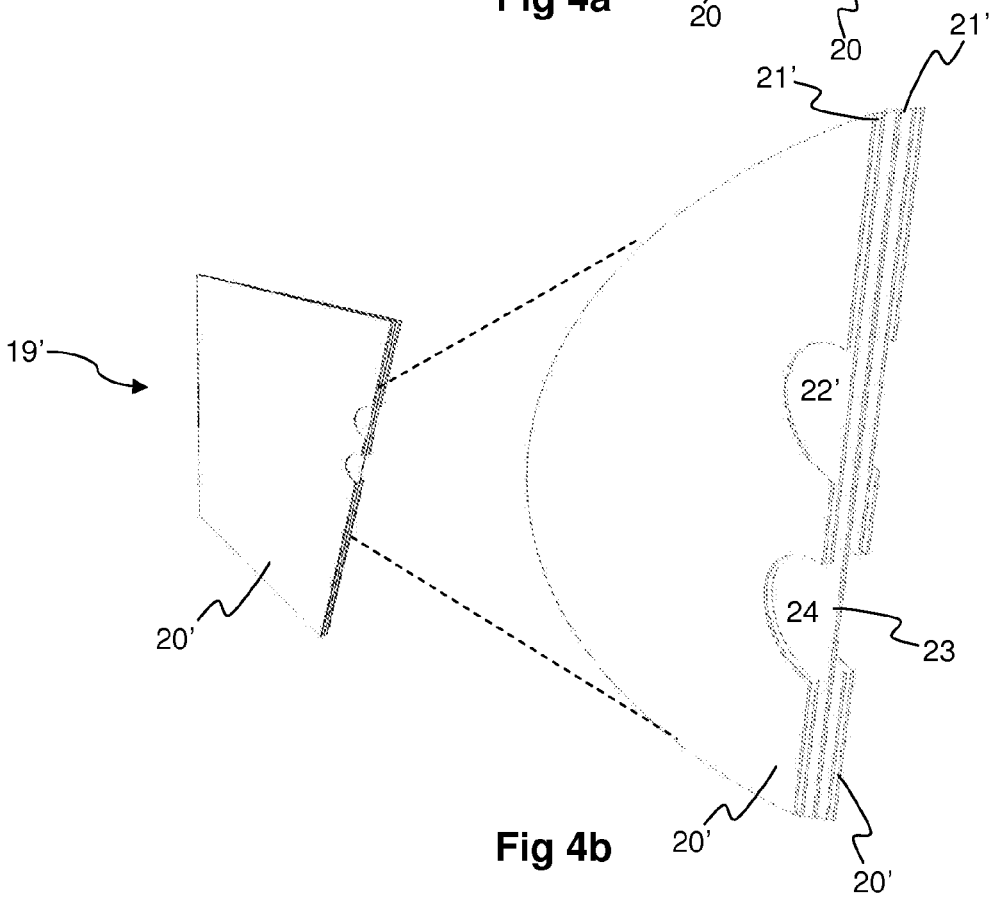

FIG. 4*b* schematically illustrates a newspaper 19' comprising a main section 20', a first subsection 21 and a second subsection 23. The first subsection 21' is visible and accessible through the cut-out 22' of the main section 20'. The second subsection 23 is visible and accessible through the cut-out 24 of both the main section 20' and the first subsection 21'.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

Itemized List of Embodiments

1. A puncher cylinder comprising a puncher knife, the cylinder being arranged for cooperation with a paper web such that the cylinder when in use can be rolled longitudinally along and in contact with the paper web, punching holes in the paper web by means of the puncher knife, which holes are punched a longitudinal distance from each other essentially corresponding to the circumference of the cylinder.

2. The puncher cylinder of item 1, wherein the puncher knife is arranged for punching holes with a maximum diameter of at least 1 centimeter.

3. The puncher cylinder of any one of the preceding items, wherein the puncher knife is arranged for punching holes which are mirror symmetrical and have an essentially round shape, such as a circular or elliptical shape.

4. The puncher cylinder of any one of the preceding items, wherein the puncher cylinder is further arranged for cooperation with an opposing cylinder arranged to be rolled longitudinally along and in contact with the paper web on the opposite side of the paper web in respect of the puncher cylinder, such that the paper web is pressed between the puncher cylinder and the opposing cylinder, the puncher cylinder being arranged to be linked with the opposing cylinder such that it has an angular velocity which is fixed in relation to the angular velocity of the opposing cylinder when the puncher cylinder is in use.

5. The puncher cylinder of any one of the preceding items, wherein the puncher cylinder further comprises a stapler, the stapler being arranged in the puncher cylinder such that staples can be placed in the paper web longitudinally essentially halfway between the punched holes when the puncher cylinder is in use.

6. A system for punching holes in a paper web, the system comprising:

a puncher cylinder according to any one of items 1-5; and an opposing cylinder;

wherein the puncher cylinder and the opposing cylinder are arranged to, when in use, roll against each other on opposite sides of the paper web, pressing the paper web between the cylinders.

7. The system of item 6, wherein the puncher cylinder and the opposing cylinder are linked such that they can have essentially the same angular velocity when the system is in use.

8. The system of any one of items 6 and 7, wherein the opposing cylinder comprises a pad, whereby the puncher knife of the puncher cylinder can meet the pad of the opposing cylinder with every revolution of the cylinders when the system is in use.

9. The system of any one of items 6-8, wherein the puncher cylinder or the opposing cylinder comprises a stapler, the stapler being arranged such that staples can be placed in the paper web when the system is in use.

10. A method of punching holes in a paper web, the method comprising:

allowing a longitudinally moving paper web to pass between and being pressed between two opposing, stationary and revolving cylinders, one of the two cylinders being a puncher cylinder comprising a puncher knife and the other of the two cylinders being an opposing cylinder; and punching a hole in the paper web by means of the puncher knife where the moving paper web is pressed between the two cylinders with each revolution of the puncher cylinder.

11. The method of item 10, further comprising:

stapling the paper web by means of a stapler comprised in the puncher cylinder or the opposing cylinder.

12. A newspaper comprising at least a first and a second separate sections wherein the second section is inlaid in the first section and the first section has two cuts through all of its sheets, the cuts forming a first recess in an edge of the sheets and a corresponding second recess in the same or another edge of the sheets, such that when the sheets are folded to form the newspaper section, they together form a single recess in an edge of the newspaper section.

13. A printing machine for producing printed articles, the printing machine including:

a first paper web arranged to pass a punching machine according to item 1; and a second paper web arranged to be combined with the first paper web after the first paper web has passed the punching machine.

14. The printing machine of item 13, arranged to punch at least one more hole per printed article in the first paper web than in the second paper web.

15. The printing machine of item 13 or 14, wherein the first paper web corresponds to a first section of the printed article and the second paper web corresponds to a second section of the printed article.

16. The printing machine of any one of items 13-15, further adapted to staple one of said paper webs separate from the other.

The invention claimed is:

1. A printing machine comprising:

a puncher cylinder including a puncher knife, the puncher cylinder cooperating with a paper web such that the puncher cylinder when in use can be rolled longitudinally along and in contact with the paper web, and punches holes in the paper web via the puncher knife, whereby holes are punched a longitudinal distance from each other which corresponds to a circumference of the puncher cylinder, wherein the puncher cylinder further includes a stapler, the stapler being arranged in the puncher cylinder such that staples can be placed in the paper web longitudinally essentially halfway between the punched holes when the puncher cylinder is in use; and a cutting cylinder including a cutting knife, wherein the printing machine is arranged such that in use, the cutting cylinder cuts the paper web through the holes, thereby forming sheets having at least two recesses.

2. The printing machine of claim 1, wherein the cutting cylinder is arranged to cut the paper web through the middle of the holes.

3. The printing machine of claim 1, wherein the cutting cylinder is arranged to cut the paper web transversely over the width of the paper web.

4. The printing machine of claim 1, wherein the puncher knife is arranged for punching holes with a maximum diameter of at least 1 centimeter.

5. The printing machine of claim 1, wherein the puncher knife is arranged for punching holes which are mirror symmetrical and have substantially at least one of a round shape, a circular shape, and an elliptical shape.

6. The printing machine of claim 1, further comprising an opposing cylinder, wherein the puncher cylinder and the opposing cylinder are arranged to, when in use, roll against each other on opposite sides of the paper web, pressing the paper web between the cylinders.

7. The printing machine of claim 6, wherein the puncher cylinder and the opposing cylinder are linked such that they can have essentially the same angular velocity when the system is in use.

8. The printing machine of claim 6, wherein the opposing cylinder comprises a pad, whereby the puncher knife of the puncher cylinder can meet the pad of the opposing cylinder with every revolution of the cylinders when the system is in use.

9. The printing machine of claim 1, wherein the folds in the sheets are made such that the at least two recesses of each sheet are superimposed.

10. A method of punching holes in a paper web, the method comprising:

allowing a longitudinally moving paper web to pass between and being pressed between two opposing and revolving cylinders, one of the two cylinders being a puncher cylinder including a puncher knife and the other of the two cylinders being an opposing cylinder;

punching a hole in the paper web by means of the puncher knife where the moving paper web is pressed between the two cylinders with each revolution of the puncher cylinder;

cutting the paper web through the hole with a cut extending continuously through the entire thickness and entire width of the complete paper web, thereby forming sheets separated from each other; and folding each sheet.

11. The method of claim 10, wherein the cutting of the paper web through the holes is performed by means of a cutting cylinder including a cutting knife.

12. The method of claim 10, further comprising:

stapling the paper web by means of a stapler included in the puncher cylinder or the opposing cylinder.

13. A printed article manufactured by the method of claim 10.

14. The printed article of claim 13, comprising at least a first section and a second separate section, wherein the second section is inlaid in the first section and the first section has two cuts through all of its sheets, the cuts forming a first recess in an edge of the sheets and a corresponding second recess in the same or another edge of the sheets, such that when the sheets are folded to form the first section, the first and second recesses together form a single recess in an edge of the first section.

15. The printed article of claim 14, wherein the first section has at least one more recess than the second section when the sheets of the first and second sections are folded.

16. The printed article of claim 14, wherein the sheets of each section are fastened together, by at least one of staples, stitches, and a glue.

17. A puncher cylinder comprising a puncher knife, the puncher cylinder being arranged for cooperation with a paper web such that the puncher cylinder when in use can be rolled longitudinally along and in contact with the paper web, punching holes in the paper web via the puncher knife, which holes are punched a longitudinal distance from each other essentially corresponding to a circumference of the puncher cylinder, wherein the puncher cylinder further includes a stapler, the stapler being arranged in the puncher cylinder such that staples can be placed in the paper web longitudinally essentially halfway between the punched holes when the puncher cylinder is in use.

* * * * *